US006636714B1

(12) United States Patent
Mastalski

(10) Patent No.: US 6,636,714 B1
(45) Date of Patent: Oct. 21, 2003

(54) ROLL HAVING RELIEVED EDGES FOR LOW STRESS BELT TRACKING FOR BELT LOOPS

(75) Inventor: Henry T. Mastalski, Webster, NY (US)

(73) Assignee: Xerox Corporation, Stamford, CT (US)

( * ) Notice: Subject to any disclaimer, the term of this patent is extended or adjusted under 35 U.S.C. 154(b) by 311 days.

(21) Appl. No.: 09/209,854

(22) Filed: Dec. 11, 1998

(51) Int. Cl.[7] ..... G03G 15/00

(52) U.S. Cl. ..... 399/165; 399/302; 399/303; 399/308; 399/312; 399/313

(58) Field of Search ..... 399/165, 162, 399/163, 302, 303, 308, 312, 313; 271/275, 198; 198/840, 843

(56) References Cited

U.S. PATENT DOCUMENTS

| | | | | | |
|---|---|---|---|---|---|
| 2,847,114 | A | * | 8/1958 | Orr | 198/806 |
| 4,061,222 | A | | 12/1977 | Rushing | 198/807 |
| T967,010 | I4 | * | 2/1978 | Stryjewski | 432/60 |
| 4,170,175 | A | | 10/1979 | Conlon | 101/1 |
| 4,174,171 | A | | 11/1979 | Hamaker | 355/3 |
| 4,253,392 | A | * | 3/1981 | Brandon et al. | 100/155 |
| 4,344,693 | A | | 8/1982 | Hamaker | 355/3 |
| 4,370,048 | A | * | 1/1983 | Shibuya et al. | 399/398 |
| 4,462,676 | A | * | 7/1984 | Shimura et al. | 399/165 |
| 4,572,417 | A | | 2/1986 | Joseph et al. | 226/20 |
| 4,693,363 | A | * | 9/1987 | Kuehnert | 198/807 |
| 4,832,186 | A | * | 5/1989 | Conrad | 198/806 X |
| 4,913,279 | A | * | 4/1990 | Tonissen | 198/806 X |
| 4,961,089 | A | | 10/1990 | Jamzadeh | 355/207 |
| 5,078,263 | A | | 1/1992 | Thompson et al. | 198/807 |
| 5,467,171 | A | | 11/1995 | Castelli et al. | 355/212 |
| 5,580,044 | A | * | 12/1996 | Wafler | 271/275 |
| 5,819,140 | A | * | 10/1998 | Iseki et al. | 399/165 |
| 5,966,564 | A | * | 10/1999 | Kizaki et al. | 399/308 |
| 5,995,792 | A | * | 11/1999 | Jo | 399/286 |
| 6,053,832 | A | * | 4/2000 | Saito | 474/122 |

FOREIGN PATENT DOCUMENTS

| | | |
|---|---|---|
| JP | 56-167164 | * 12/1981 |
| JP | 58-109339 | * 6/1983 |
| JP | 1-281237 | * 11/1989 |
| JP | 5-297953 | * 11/1993 |
| JP | 5-303291 | * 11/1993 |
| JP | 6-009096 | * 1/1994 |
| JP | 8-67373 | * 3/1996 |
| JP | 8-106218 | * 4/1996 |
| JP | 8-217302 | * 8/1996 |
| JP | 9-12173 | * 1/1997 |
| JP | 09-54509 | * 7/1997 |
| JP | 9-297469 | * 11/1997 |

* cited by examiner

*Primary Examiner*—Quana M. Grainger
(74) *Attorney, Agent, or Firm*—Kevin P. Kepner; William Eipert

(57) ABSTRACT

An apparatus for steering a moving web, particularly in an electrophotographic printing machine of the type having an endless photoreceptor belt supported by a plurality of rolls and arranged to move in a predetermined path through a plurality of processing stations disposed therealong the belt being of the type which is supported by a plurality of rolls. A roll for steering the belt is adapted for rotational movement about a first axis and tilting movement about a second axis transverse to the first axis. The steering roll further is cylindrical along its length, however the ends of the cylindrical portion of the roll are radiused to reduce the stress induced on the belt edge when the roll is tilted to effect steering of the belt. Additionally, the radiused ends may be filled with a compliant material to provide needed edge support while still reducing the stress induced at the belt edge. A belt edge sensor can be utilized to track the position of the belt and feed that information to the machine controller which then actuates the steering motor to tilt the roll to the extent and for as long as is necessary to maintain the proper belt tracking pattern on the roll.

6 Claims, 4 Drawing Sheets

ROLL HAVING RELIEVED EDGES FOR LOW STRESS BELT TRACKING FOR BELT LOOPS

This invention relates generally to a belt steering system and more particularly concerns a device to steer a belt to maintain proper belt tracking characteristics while at the same time eliminating or minimizing edge stress induced on the belt which causes belt failure.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

Many commercial applications of the above process employ a photoconductive member in the form of a belt which is supported about a predetermined path past a plurality of processing stations to ultimately form a reproduced image on copy paper. The location of the latent image recorded on the photoconductive belt must be precisely defined in order to have the various processing stations acting thereon optimize copy quality. To this end, it is critical that the lateral alignment of the photoconductive belt be controlled within prescribed tolerances. Only in this manner will a photoconductive belt move through a predetermined path so that the processing stations disposed thereabout will be located precisely relative to the latent image recorded thereon. Lateral movement of the photoconductive belt is particularly a problem in connection with color copiers where the precise tracking of the belt is mandatory for acceptable copy quality.

When considering control of the lateral movement of the belt, it is well known that if the belt were perfectly constructed and entrained about perfectly cylindrical rollers mounted and secured in an exactly parallel relationship with one another, there would be no lateral movement of the belt. In actual practice, however, this is not feasible. Due to the imperfections in the system's geometry, the belt velocity vector is not normal to the roller axis of the rotation, and the belt will move laterally relative to a roller until reaching a kinematically stable position.

Typically, the belt edge position is monitored and a steering roll is tilted to cause the belt to track in a desired direction to keep the belt in the desired lateral position. The tilting of a roll with the tensioned belt thereon causes a sloping tension distribution across the width of the belt with the greatest tension at the edge of the belt. This tension produces a stress at the portion of the belt that is least able to bear the excess stress, the edge.

Accordingly, it is desirable to develop a belt steering system that uses a steering roll and other support and drive rolls, which reduces or minimizes the stress induced at the very edge of a belt.

The following disclosures may be relevant to various aspects of the present invention:

U.S. Pat. No. 5,467,171

Inventor: Castelli et al.

Issue Date: Nov. 14, 1995

U.S. Pat. No. 4,061,222

Inventor: Rushing

Issue Date: Dec. 6, 1977

U.S. Pat. No. 4,572,417

Inventor: Joseph et al.

Issue Date: Feb. 25, 1986

U.S. Pat. No. 4,170,175

Inventor: Conlon, Jr.

Issue Date: Oct. 9, 1979

U.S. Pat. No. 4,174,171

Inventor: Hamaker et ano.

Issue Date: Nov. 13, 1979

U.S. Pat. No. 4,344,693

Inventor: Hamaker

Issue Date: Aug. 17, 1982

U.S. Pat. No. 4,961,089

Inventor: Jamzadeh

Issue Date: Oct. 2, 1990

U.S. Pat. No. 5,078,263

Inventor: Thompson et al.

Issue Date: Jan. 7, 1992

The relevant portions of the foregoing disclosures may be briefly summarized as follows:

U.S. Pat. No. 5,467,171 to Castelli et al. describes a web steering roll for supporting the web being adapted for rotational movement about a first axis and tilting movement about a second axis transverse to the first axis is used. A compact internal tilting mechanism utilizing a motor inside of the roll connected at one end to a first pin extending outwardly from one end of said steering roll, the first pin being positioned eccentrically of the rotary axis, and a second pin extending outwardly at the other end of the roll also positioned eccentrically of the rotary axis and connected to the motor through a connecting mechanism so that when said motor is actuated the second pin rotates in a direction opposed to that of the first pin.

U.S. Pat. No. 4,061,222 to Rushing discloses an apparatus for tracking an endless belt along an endless path by a tiltable belt steering roller whose position is continually adjusted so that the belt is maintained at a stable equilibrium position despite changes in the belt shape. The adjustment is determined by control circuitry which produces signals representative of lateral belt edge position, a desired belt edge position, and either a steering roller position or an instantaneous lateral belt deviation rate to produce a control signal which is applied to a gear motor to control the tilt angle of the steering belt roller. This apparatus utilizes the absolute control method.

U.S. Pat. No. 4,572,417 to Joseph et al. discloses an apparatus for controlling lateral, cross track alignment of a web moving along a path to minimize lateral deviation between successive discrete areas of the web. A steering roller supports the web for movement along the path and is rotatable about an axis perpendicular to a plane of the span of the web approaching the steering roller.

U.S. Pat. No. 4,170,175 to Conlon, Jr. discloses a system for tracking an endless belt which automatically compensates for creep of the belt. The belt is supported by four rollers. A first is a drive roller, a second and third are idler rollers, and a fourth roller is an idler roller with flared ends. The flared roller provides passive tracking without electronic or active feedback. One of the idler rollers is spring loaded such that when an edge of the belt creeps up on one of the flared ends of the fourth roller, that side of the spring loaded roller is caused to tilt due to increased belt stiffness on that side. This positions the belt laterally toward a central position.

U.S. Pat. No. 4,174,171 to Hamaker et al. disclose an apparatus for controlling the lateral alignment of a moving photoconductive belt. A resilient support constrains lateral movement of the belt causing a moment to be applied to a pivotably mounted steering post. As a result, the steering post pivots in a direction to restore the belt along a predetermined path. This apparatus is passive and provides no active electronic feedback.

U.S. Pat. No. 4,344,693 to Hamaker disclose an apparatus for controlling the lateral alignment of a moving photoconductive belt. Lateral movement of the belt causes a frictional force to be applied to the belt support. The frictional force tilts the belt support to restore the belt to the predetermined path of movement. This apparatus is passive and provides no active electronic feedback.

U.S. Pat. No. 4,961,089 to Jamzadeh discloses a method and apparatus for controlling lateral movement of a web along an endless path. The lateral position of the web is monitored and a determination is made by a control unit if the web is within predetermined limits such that a copying operation can be completed while the web is still properly tracking. If the web is not tracking properly, or if it is predicted that the web will track beyond its predetermined lateral limits within a copying operation, a correcting step is taken prior to the copying operation. The correcting step determines a tilt angle for a steering roller. Upon completion of the correcting step, the apparatus returns to a monitoring capacity and does not provide corrective measures until the web is beyond or is predicted to go beyond the predetermined limits during a subsequent copying operation. This insures that copying operations have proper registration and do not include corrective steps during the copying operation which might interfere with the registration. This apparatus uses an absolute scheme to determine corrective action.

U.S. Pat. No. 5,078,263 to Thompson et al. discloses an active steering method that introduces corrective skew through a small rotation about the "soft-axis" of one or more idler rolls. The skew is introduced by an external connection to a servomotor to alter the angle at which the web enters or leaves the roll to cause the web to walk along the roll.

In accordance with one aspect of the present invention, there is provided an apparatus for controlling a web moving along a predetermined path. The apparatus comprises an apparatus for controlling and driving a web moving along a predetermined path, comprising a web steering roll for supporting the web, said web steering roll being adapted for driven rotational movement about a first axis and tilting movement about a second axis transverse to the first axis, said web steering roll comprising a cylindrical member supported for rotational movement about its longitudinal axis wherein each end of said cylindrical member is radiused to provide a nonsharp contact point with the web, means for sensing movement of the web in a direction substantially normal to the predetermined path and generating a signal indicative thereof and means, responsive to the signal generated by said sensing and generating means, for tilting said steering roll about the second axis, to return the web to the predetermined path.

Pursuant to another aspect of the present invention, there is provided an electrophotographic printing machine of the type having an endless photoreceptor belt supported by a plurality of rolls and arranged to move in a predetermined path through a plurality of processing stations disposed therealong. The improvement includes a belt steering roll for supporting the belt, said belt steering roll being adapted for driven rotational movement about a first axis and tilting movement about a second axis transverse to the first axis, said belt steering roll comprising a cylindrical member supported for rotational movement about its longitudinal axis wherein each end of said cylindrical member is radiused to provide a nonsharp transition from contact, within the belt edges, means for sensing movement of the belt in a direction substantially normal to the predetermined path and generating a signal indicative thereof; and means, responsive to the signal generated by said sensing and generating means, for tilting said steering roll about the second axis, to return the belt to the predetermined path.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
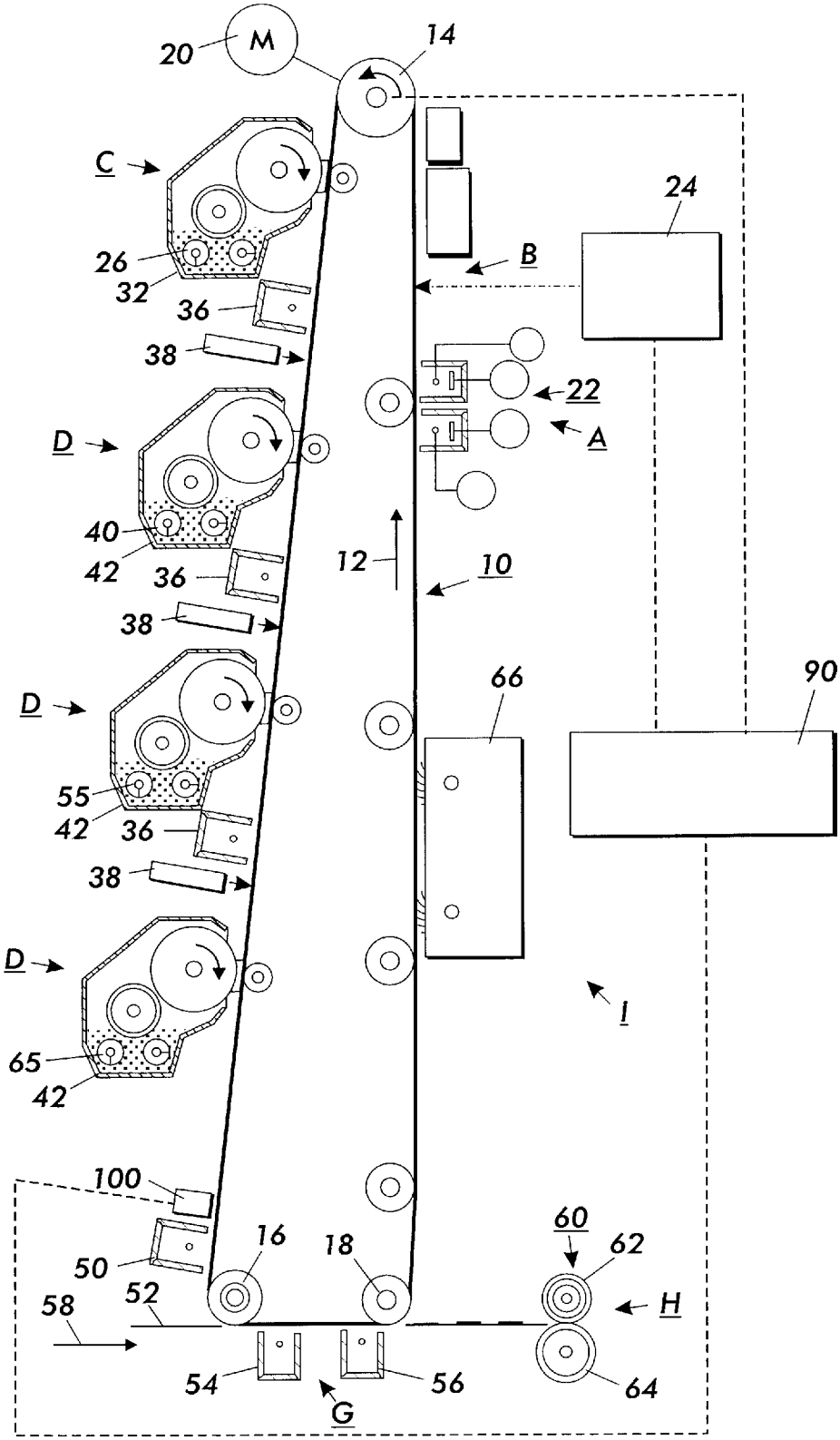
FIG. 1 is a schematic elevational view of a full color, single pass, image on image electrophotographic printing machine incorporating the FIG. 1 system therein.

Turning now to FIG. 1, the electrophotographic printing machine of the present invention uses a charge retentive surface in the form of an Active Matrix (AMAT) photoreceptor belt 10 supported for movement in the direction indicated by arrow 12, for advancing sequentially through the various xerographic process stations. The belt is entrained about a drive roller 14 and tension and steering rollers 16 and 18 respectively, roller 14 is operatively connected to a drive motor 20 for effecting movement of the belt through the xerographic stations.

With continued reference to FIG. 1, a portion of belt 10 passes through charging station A where a corona generating device, indicated generally by the reference numeral 22, charges the photoconductive surface of belt 10 to a relative high, substantially uniform, preferably negative potential.

Next, the charged portion of photoconductive surface is advanced through an imaging station B. At exposure station B, the uniformly charged belt 10 is exposed to a laser based output scanning device 24 which causes the charge retentive surface to be discharged in accordance with the output from the scanning device. Preferably the scanning device is a laser Raster Output Scanner (ROS). Alternatively, the ROS could be replaced by other xerographic exposure devices such as LED arrays.

The photoreceptor, which is initially charged to a voltage $V_0$, undergoes dark decay to a level $V_{ddp}$ equal to about −500 volts. When exposed at the exposure station B it is discharged to $V_{image}$ equal to about −50 volts. Thus after exposure, the photoreceptor contains a monopolar voltage profile of high and low voltages, the former corresponding to charged areas and the latter corresponding to discharged or image areas.

At a first development station C, developer structure, indicated generally by the reference numeral 32 utilizing a hybrid jumping development (HJD) system, the development roll, better known as the donor roll, is powered by two development fields (potentials across an air gap). The first field is the ac jumping field which is used for toner cloud generation. The second field is the dc development field which is used to control the amount of developed toner mass on the photoreceptor. The toner cloud causes charged toner particles 26 to be attracted to the electrostatic latent image. Appropriate developer biasing is accomplished via a power supply. This type of system is a noncontact type in which only toner particles (black, for example) are attracted to the latent image and there is no mechanical contact between the photoreceptor and a toner delivery device to disturb a previously developed, but unfixed, image.

The developed but unfixed image is then transported past a second charging device 36 where the photoreceptor is recharged to a predetermined level.

A second exposure/imaging is performed by imaging device 38 which comprises a laser based output structure and is utilized for selectively discharging the photoreceptor on toned areas and/or bare areas, pursuant to the image to be developed with the second color toner. At this point, the photoreceptor contains toned and untoned areas at relatively high voltage levels and toned and untoned areas at relatively low voltage levels. These low voltage areas represent image areas which are developed using discharged area development (DAD). To this end, a negatively charged, developer material 40 comprising color toner is employed. The toner, which by way of example may be yellow, is contained in a developer housing structure 42 disposed at a second developer station D and is presented to the latent images on the photoreceptor by way of a second HSD developer system. A power supply (not shown) serves to electrically bias the developer structure to a level effective to develop the discharged image areas with negatively charged yellow toner particles 40.

The above procedure is repeated for a third image for a third suitable color toner such as magenta and for a fourth image and suitable color toner such as cyan. The exposure control scheme described below may be utilized for these subsequent imaging steps. In this manner a full color composite toner image is developed on the photoreceptor belt.

To the extent to which some toner charge is totally neutralized, or the polarity reversed, thereby causing the composite image developed on the photoreceptor to consist of both positive and negative toner, a negative pre-transfer dicorotron member 50 is provided to condition the toner for effective transfer to a substrate using positive corona discharge.

Subsequent to image development a sheet of support material 52 is moved into contact with the toner images at transfer station G. The sheet of support material is advanced to transfer station G by conventional sheet feeding apparatus, not shown. Preferably, the sheet feeding apparatus includes a feed roll contacting the uppermost sheet of a stack of copy sheets. The feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station G.

Transfer station G includes a transfer dicorotron 54 which sprays positive ions onto the backside of sheet 52. This attracts the negatively charged toner powder images from the belt 10 to sheet 52. A detack dicorotron 56 is provided for facilitating stripping of the sheets from the belt 10.

After transfer, the sheet continues to move, in the direction of arrow 58, onto a conveyor (not shown) which advances the sheet to fusing station H. Fusing station H includes a fuser assembly, indicated generally by the reference numeral 60, which permanently affixes the transferred powder image to sheet 52. Preferably, fuser assembly 60 comprises a heated fuser roller 62 and a backup or pressure roller 64. Sheet 52 passes between fuser roller 62 and backup roller 64 with the toner powder image contacting fuser roller 62. In this manner, the toner powder images are permanently affixed to sheet 52 after it is allowed to cool. After fusing, a chute, not shown, guides the advancing sheets 52 to a catch tray, not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station I using a cleaning brush structure contained in a housing 66.

It is believed that the foregoing description is sufficient for the purposes of the present application to illustrate the general operation of a color printing machine.

Figure 2:
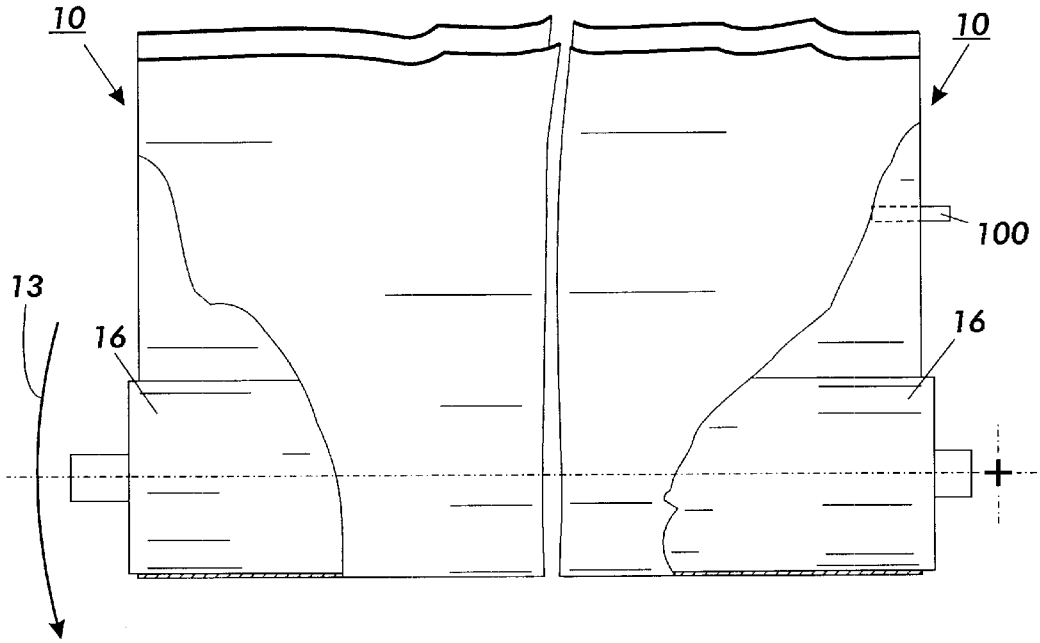
FIG. 2 is a plan view of the a known steering system.

As mentioned previously, printing systems such as those described above require that the exact position of the belt be known and that the belt is steered to the desired position in order to assure registration of the composite image. Typical systems utilize a steering roll 16 as illustrated in FIG. 2 to cause the belt to "walk" in one direction or the other to effect steering of the belt. The tilting of the roll causes lateral movement by the web, which in turn, changes the signal produced by a belt edge detector 100 and sent to controller 90, which ultimately causes a modulation of the web about a point to effect control.

Figure 3:
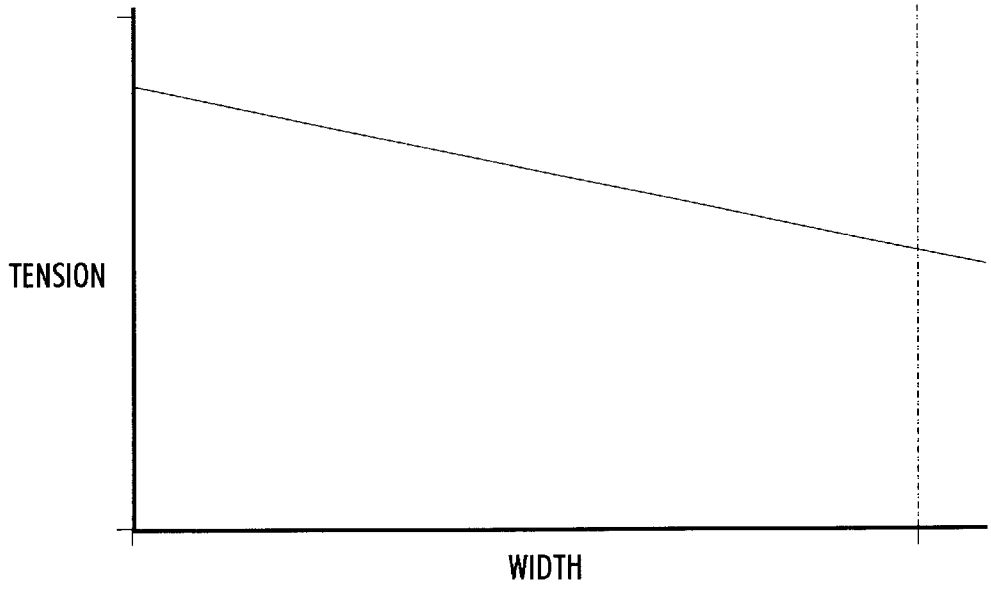
FIG. 3 is a graph illustrating the tension distribution in the FIG. 2 device.

This tilting of the roll 16 in the direction of arrow 13 produces a tension distribution across the width of the belt 10 which is illustrated in FIG. 3. The belt 10 or web actually moves away from the side with the greatest tension thereby causing the belt "walk". As is seen in FIGS. 2 and 3, the stress induced on the belt is greatest at the edges of the belt. Unfortunately, with belts that are electro-formed Ni and 0.002 to 0.003 inches thick, the edge of the belt is the very portion least able to bear the increased stress. This may be due to inherent weaknesses at the edge of such belts caused by laser slitting or may also be due to seam welding in welded non electro-formed belts. This can lead to premature belt failure due to cracking of the edges.

Figure 4:
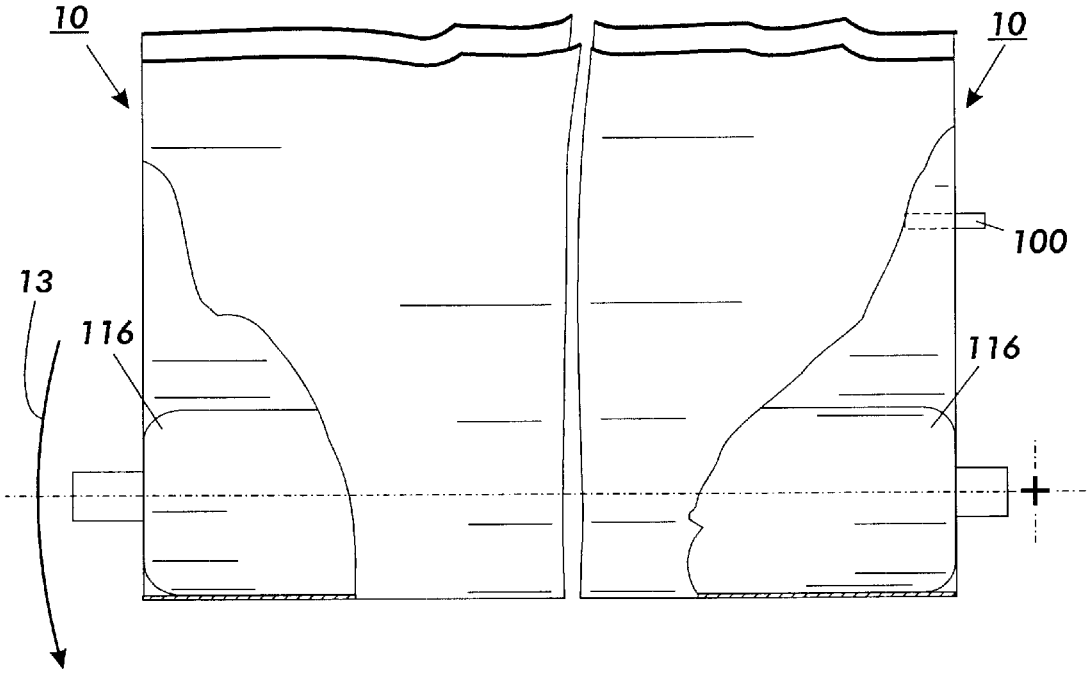
FIG. 4 is a plan view of the steering system of the present invention.
Figure 5:
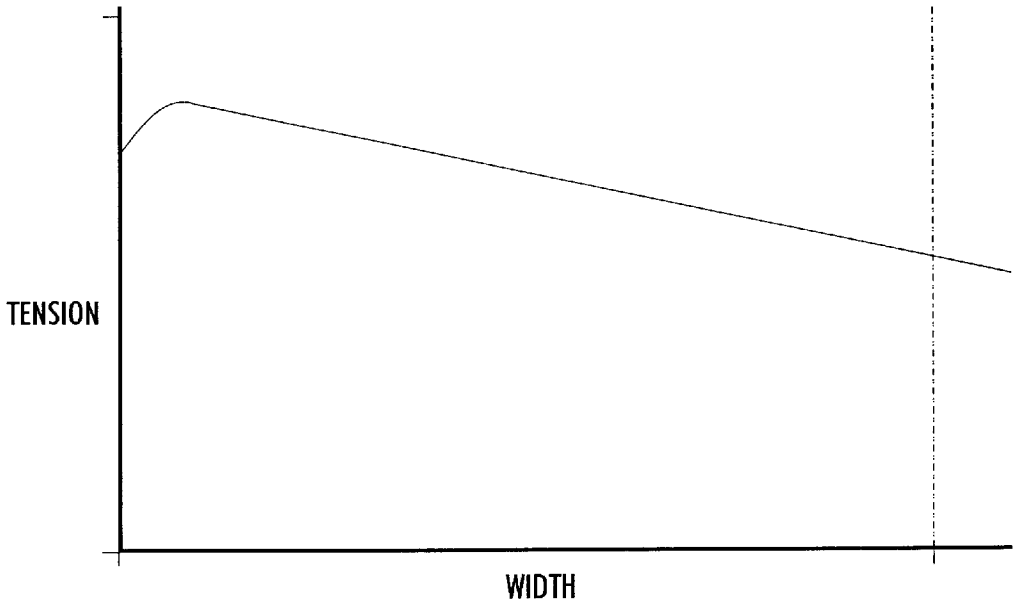
FIG. 5 is a graph of the tension distribution in the device of the present invention.
Figure 6:
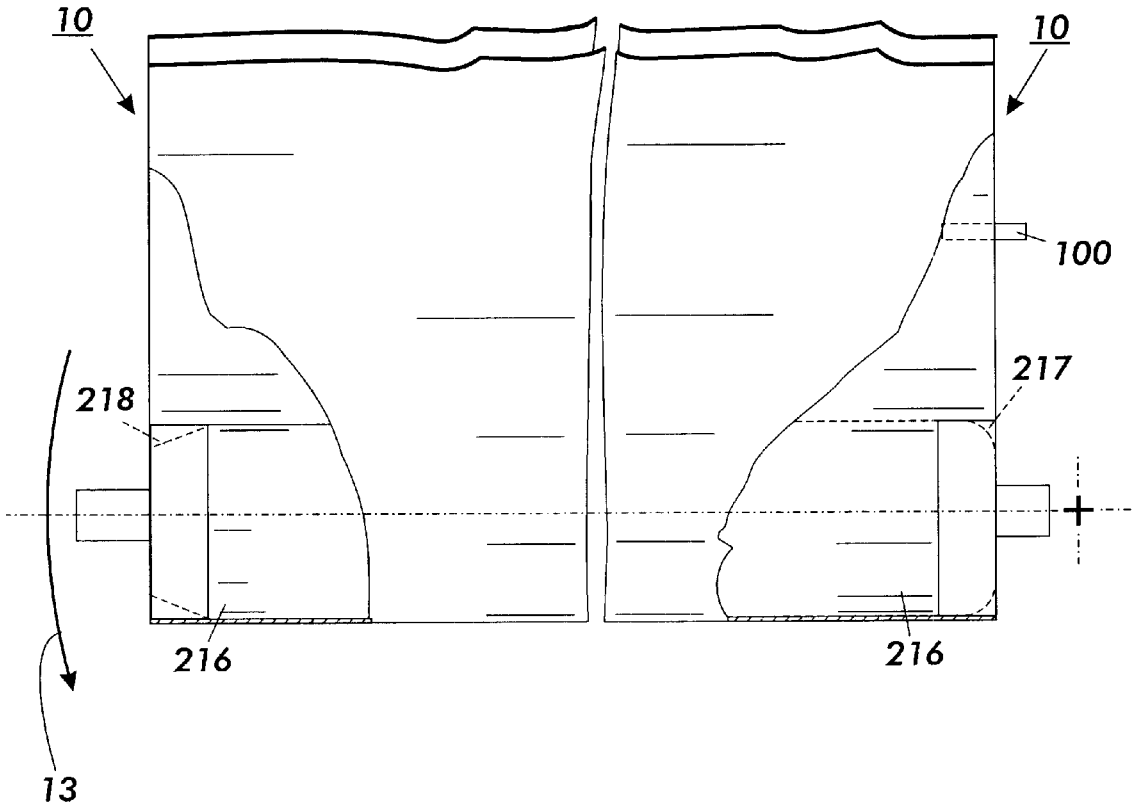
FIG. 6 is a plan view of the steering system of the present invention using an alternative filled end roll.

As seen in FIGS. 4 and 5, a steering roll 116 having the edges of the roll radiused 117 or relieved still effectuates a walk upon the belt, however, the high stress point is moved to a portion of the belt away from the edge as seen in the graph of FIG. 5. This radiusing of the roll 116 minimizes the sharp point of contact between the belt 10 the edge of the roll 116 and reduces the stress induced on the belt 10 at the edge. The major contact length of the roller with the belt is a true cylinder with the edge radii undercut. An alternative to leaving the transition to the undercut radiused 217 or relieved 218 is to fill the ends of the roll 216 with a nonrigid material (FIG. 6). This alternative will lessen the stress relief to a degree proportionally dependent upon the durometer or compliance of the material chosen as the filler but may be necessary in some instances to allow components that contact the belt at the edge to properly ride along the belt edge. While radiusing of the end is the preferred method of relief, satisfactory results can be obtained by other methods of relieving such as chamfering at an angle which removes the sharp contact transition point from the inside of the belt, well within the edges of the belt.

The examples illustrated are shown using the steering roll however, each of the rolls in the drive and support system can be relieved as the tension induced when the steering roll is tilted is transferred among all of the rolls in the system.

In recapitulation, there is provided an apparatus for driving, supporting and steering a moving web, particularly in an electrophotographic printing machine of the type having an endless photoreceptor belt supported by a plurality of rolls and arranged to move in a predetermined path through a plurality of processing stations disposed therealong the belt being of the type which is supported by a plurality of rolls. A plurality of rolls are provided including a roll for steering the belt, each of said rolls is adapted for rotational movement about a first axis and said steering roll rolls is adapted for rotational movement about a first axis and tilting movement about a second axis transverse to the first axis. Each roll is cylindrical along its length, however the ends of the cylindrical portion of the roll are relieved to reduce the stress induced on the belt edge when the roll is tilted to effect steering of the belt. Additionally, the relieved ends may be filled with a compliant material to provide needed edge support while still reducing the stress induced at the belt edge. A preferred method of relieving the end is to radius the ends of the cylindrical portion of the roll. A belt edge sensor can be utilized to track the position of the belt and feed that information to the machine controller which then actuates the steering motor to tilt the roll to the extent and for as long as is necessary to maintain the proper belt tracking pattern on the roll.

While illustrated in use with an electro-formed photoreceptor belt the invention is applicable to other types of webs such as paper transfer belts, moving vacuum platen belts, other seamed or seamless photoreceptor belts, or any wide, thin section belt, metallic, plastic, or other material, subject to tear propagation from the edges, or fatigue failure propagation from the edges.

It is, therefore, apparent that there has been provided in accordance with the present invention, a steering system for an endless loop belt or web that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

I claim:

1. An apparatus for controlling and driving a web moving along a predetermined path, comprising:

a plurality of rolls for supporting and driving said web, including a web steering roll for supporting the web, each of said plurality of rolls being adapted for driven rotational movement about a first axis and said web steering roll being adapted for driven rotational movement about a first axis and tilting movement about a second axis transverse to the first axis, each of said plurality of rolls comprising a cylindrical member supported for rotational movement about its longitudinal axis wherein each end of said cylindrical member comprises a relieved portion to provide a nonsharp contact point with the web, wherein at least one of said plurality of rolls further comprises a compliant fill material added to said relieved portion of said cylindrical member to provide said cylindrical member with a substantially constant diameter along its length to support the web;

means for sensing movement of the web In a direction substantially normal to the predetermined path and generating a signal indicative thereof; and means, responsive to the signal generated by said sensing and generating means, for tilting said steering roll about the second axis, to return the web to the predetermined path.

2. An apparatus as claimed in claim 1, wherein a profile of the relieved portion of said cylindrical member is a radius.

3. An electrophotographic printing machine of a type having an endless photoreceptor belt supported by a plurality of rolls and arranged to move in a predetermined path through a plurality of processing stations disposed therealong, including:

a plurality of rolls for supporting and driving said belt, including a belt steering roll for supporting the belt, each of said plurality of rolls being adapted for driven rotational movement about a first axis and said belt steering roll being adapted for driven rotational movement about a first axis and tilting movement about a second axis transverse to the first axis, each of said plurality of rolls comprising a cylindrical member supported for rotational movement about its longitudinal axis wherein each end of said cylindrical member comprises a relieved portion to provide a nonsharp contact point with the belt, wherein at least one of said plurality of rolls further comprises a compliant fill material added to the relieved portion of said cylindrical member to provide said cylindrical member with a substantially constant diameter along its length to support the belt;

means for sensing movement of the belt in a direction substantially normal to the predetermined path and generating a signal indicative thereof; and means, responsive to the signal generated by said sensing and generating means, for tilting said steering roll about the second axis, to return the belt to the predetermined path.

4. A printing machine as claimed in claim 3, wherein a profile of the relieved portion of said cylindrical member is a radius.

5. A roll for supporting a web in a drive system wherein a web is moved along a predetermined path comprising:

a support member;

a cylindrical member to contact and support the web, coupled to said support member for rotational movement about its longitudinal axis, wherein said cylindrical member comprises a relieved portion at each end to reduce the diameter thereof, said cylindrical member further comprising a compliant fill material added to the relieved portion to provide a substantially constant diameter along the length of said cylindrical member and reduce tension at a point of contact of the support member and the edge of the web.

6. A roll as claimed in claim 5 wherein a profile of the relieved portion of said cylindrical member is a radius.

* * * * *